US012808074B2

(12) United States Patent
Sauda et al.

(10) Patent No.: US 12,808,074 B2
(45) Date of Patent: Nov. 24, 2026

(54) ZINC RECOVERY METHOD

(71) Applicants: JGC CORPORATION, Yokohama (JP); Kinotech Corporation, Tokyo (JP)

(72) Inventors: Kenzo Sauda, Yokohama (JP); Masaaki Iosaki, Tokyo (JP)

(73) Assignees: JGC CORPORATION, Yokohama (JP); Kinotech Corporation, Tokyo (JP)

( * ) Notice: Subject to any disclaimer, the term of this patent is extended or adjusted under 35 U.S.C. 154(b) by 658 days.

(21) Appl. No.: 18/266,711

(22) PCT Filed: Dec. 14, 2020

(86) PCT No.: PCT/JP2020/046569

§ 371 (c)(1),
(2) Date: Jun. 12, 2023

(87) PCT Pub. No.: WO2022/130462

PCT Pub. Date: Jun. 23, 2022

(65) Prior Publication Data

US 2024/0044029 A1 Feb. 8, 2024

(51) Int. Cl.

| | |
|---|---|
| ***C25C 1/16*** | (2006.01) |
| ***C22B 19/20*** | (2006.01) |
| ***C22B 19/30*** | (2006.01) |

(52) U.S. Cl.

CPC ..... *C25C 1/16* (2013.01); *C22B 19/20* (2013.01); *C22B 19/30* (2013.01)

(58) Field of Classification Search

None

See application file for complete search history.

(56) References Cited

U.S. PATENT DOCUMENTS

| | | | | |
|---|---|---|---|---|
| 3,743,501 | A * | 7/1973 | Cusanelli et al. | C22B 19/24 205/604 |
| 4,606,765 | A | 8/1986 | Ferlay | |
| 5,106,467 | A * | 4/1992 | Leeker | C22B 19/24 205/684 |
| 2008/0206127 | A1* | 8/2008 | Koningen | C22B 19/28 423/633 |

(Continued)

FOREIGN PATENT DOCUMENTS

| | | |
|---|---|---|
| DE | 3301310 A1 | 5/1984 |
| EP | 2 753 721 B1 | 12/2015 |

(Continued)

OTHER PUBLICATIONS

Jha et al., Review of hydrometallurgical recovery of zinc from industrial wastes, Resources, Conservation and Recycling, vol. 33, No. 1, Aug. 2001, pp. 1-22 (Year: 2001).*

(Continued)

*Primary Examiner* — Harry D Wilkins, III

(74) *Attorney, Agent, or Firm* — WHDA, LLP

(57) ABSTRACT

The present zinc recovery method is characterized in including a dissolving process of treating a raw material containing zinc with an alkaline fluid at a temperature equal to or higher than 100° C. to dissolve zinc contained in the raw material, and a recovering process of recovering zinc extracted from the raw material by the dissolving process.

9 Claims, 3 Drawing Sheets

(56) References Cited

U.S. PATENT DOCUMENTS

2013/0064743 A1 3/2013 Laurin et al.

FOREIGN PATENT DOCUMENTS

| | | | |
|---|---|---|---|
| FR | 2 535 736 | A1 | 5/1984 |
| JP | 57-501384 | A | 8/1982 |
| JP | 59-133337 | A | 7/1984 |
| JP | 2014-526614 | A | 10/2014 |
| WO | 81/03500 | A1 | 12/1981 |
| WO | 2013/036268 | A1 | 3/2013 |

OTHER PUBLICATIONS

International Search Report dated Feb. 22, 2021, issued in counterpart International Application No. PCT/JP2020/046569. (2 pages).
Mordogan, H. et al., "Caustic Soda Leach of Electric Arc Furnace Dust", Turkish Journal of Engineering and Environmental Sciences, (1999), vol. 23, pp. 199-207. Cited in Specification. (10 pages).
Afifi, S. et al., "On the Electrowinning of Zinc from Alkaline Zincate Solutions", Journal of The Electrochemical Society, (1991), vol. 138, No. 7, pp. 1929-1933. Cited in Specification. (5 pages).
Xia, Dan Kui et al., "Recovery of Zinc from Zinc Ferrite and Electric Arc Furnace Dust", Queen's University, Kingston, Ontario, Canada(1997), doctoral thesis. Cited in Specification. (240 pages).

* cited by examiner

ZINC RECOVERY METHOD

TECHNICAL FIELD

The present invention relates to a zinc recovery method.

BACKGROUND ART

Iron scraps are treated as a raw material of iron making for the purpose of recycling. Fine powder generated in iron-making processes is recovered as steelmaking dust by a collecting device such as a dust collector. The steelmaking dust is called "blast furnace dust" when recovered from a blast furnace, and "electric arc furnace dust" when recovered from an electric arc furnace. Derived from iron scraps plated with zinc or the like, a large quantity of metals such as zinc and lead that are volatile at high temperatures is contained in the steelmaking dust. Therefore, the steelmaking dust has drawn attention as resources.

Non Patent Document 1 describes that the Zn recovery rate is decreased in alkali leaching of electric arc furnace dust using NaOH at 20° C. to 80° C. due to presence of insoluble zinc ferrite ($ZnFe_2O_4$). Non Patent Document 2 describes that electrowinning (EW) of zinc from an alkaline solution at 30° C. to 75° C. is performed. Non Patent Document 3 describes in pages 75 to 79 and 91 to 98 that zinc is leached from zinc ferrite and electric arc furnace dust using NaOH at 80° C. (353 K) or 90° C. (363 K).

As a conventional technique, a method of dissolving zinc ferrite or electric arc furnace dust in an alkaline solution in a condition equal to or lower than 90° C. has been studied. However, the zinc dissolution rate in the conventional technique remains at about 60% to 70%. Furthermore, a long retention time is required for the dissolution and this technique is not commercialized.

Meanwhile, a method of roasting dust along with an additive containing calcium (Ca) salt at a high temperature between 800° C. and 1000° C. to generate binary calcium ferrite ($2CaO{\cdot}Fe_2O_3$) and zinc oxide (ZnO) from zinc ferrite, and subsequently dissolving ZnO, which is highly soluble in alkali, in alkali has been considered as a dry method. However, in this method, energy for high-temperature roasting involves a significant operating cost.

PRIOR ART DOCUMENT

Non Patent Document

Non Patent Document 1: H. Mordogan et al., "Caustic Soda Leach of Electric Arc Furnace Dust", Turkish Journal of Engineering and Environmental Sciences, 1999, Vol. 23, p. 199 to 207

Non Patent Document 2: S. Afifi et al., "On the Electrowinning of Zinc from Alkaline Zincate Solutions", Journal of The Electrochemical Society, 1991, Vol. 138, p. 1929 to 1933

Non Patent Document 3: Dan Kui Xia, "Recovery of Zinc from Zinc Ferrite and Electric Arc Furnace Dust", Queen's University, 1997, doctoral thesis

SUMMARY OF THE INVENTION

Problem to be Solved by the Invention

An object of the present invention is to provide a zinc recovery method that enables zinc to be effectively dissolved even when a raw material containing zinc contains a hardly-soluble zinc compound such as zinc ferrite.

Means for Solving the Problem

A first aspect of the present invention is a zinc recovery method, comprising: a dissolving step of treating a raw material containing zinc with an alkaline fluid at a temperature equal or higher than 100° C. to dissolve zinc contained in the raw material; and a recovering step of recovering zinc extracted from the raw material by the dissolving step.

A second aspect of the present invention is the zinc recovery method according to the first aspect, wherein the raw material contains iron.

A third aspect of the present invention is the zinc recovery method according to the first or second aspect, wherein the raw material contains zinc ferrite.

A fourth aspect of the present invention is the zinc recovery method according to any one of the first to third aspects, wherein the dissolving step is performed in atmospheric pressure and at a temperature between 100° C. and 200° C.

A fifth aspect of the present invention is the zinc recovery method according to any one of the first to third aspects, wherein the dissolving step is performed under a pressurized condition in pressure higher than atmospheric pressure by 0.017 MPa to 2 MPa and at a temperature between 105° C. and 220° C.

A sixth aspect of the present invention is the zinc recovery method according to any one of the first to fifth aspects, wherein the recovering step includes an electrolyzing step of obtaining metallic zinc from a liquid phase containing zinc by electrolysis, and an alkali washing step of washing the raw material with an alkali aqueous solution to remove soluble halogen compounds prior to the dissolving step is included.

A seventh aspect of the present invention is the zinc recovery method according to any one of the first to sixth aspects, wherein the raw material contains an organic halogen compound, the recovering step includes an electrolyzing step of obtaining metallic zinc from a liquid phase containing zinc by electrolysis, and the organic halogen compound is decomposed with the alkaline fluid in the dissolving step to discharge halogen outside a system prior to the electrolyzing step.

An eighth aspect of the present invention is the zinc recovery method according to any one of the first to seventh aspects, wherein the recovering step includes a solid-liquid separating step of separating a solid phase containing iron contained in the raw material, and a liquid phase containing zinc from each other.

A ninth aspect of the present invention is the zinc recovery method according to any one of the first to eighth aspects, wherein zinc is recovered as a zinc metal, zinc oxide, or zinc carbonate in the recovering step.

A tenth aspect of the present invention is the zinc recovery method according to any one of the first to ninth aspects, wherein the recovering step includes an electrolyzing step of obtaining metallic zinc from a liquid phase containing zinc by electrolysis, and a chlorine concentration of the liquid phase is equal to or lower than 1000 ppm in the electrolyzing step.

An eleventh aspect of the present invention is the zinc recovery method according to any one of the first to tenth aspects, wherein a reproducing step of reproducing an alkaline fluid from alkali metal salt contained in residues having been subjected to the recovering step by electrolysis or concentration is included, and the alkaline fluid obtained in the reproducing step is supplied to the dissolving step.

Effect of the Invention

According to the first aspect of the present invention, even when a raw material containing zinc contains a hardly-soluble zinc compound such as zinc ferrite, zinc can be effectively dissolved and recovered.

According to the second aspect of the present invention, steelmaking dust such as blast furnace dust and electric arc furnace dust, iron scraps, and the like can be used as a raw material.

According to the third aspect of the present invention, the present method is also applicable to a raw material in which iron content reacts with zinc in steelmaking dust such as blast furnace dust or electric arc furnace dust in an oxidation condition to generate zinc ferrite.

According to the fourth aspect of the present invention, the present method is applicable to a device with an inner part that is open to the atmosphere, and facilities can be more simplified.

According to the fifth aspect of the present invention, boiling of moisture can be suppressed to enable a high-temperature alkaline fluid to be stably handled.

According to the sixth aspect of the present invention, a zinc metal can be produced while halogen compound contained as impurities in steelmaking dust or the like is removed to suppress influences of halogens in electrolysis.

According to the seventh aspect of the present invention, a zinc metal can be produced while organic halogen compound contained as impurities in steelmaking dust or the like is decomposed and influences of halogen in electrolysis are suppressed.

According to the eighth aspect of the present invention, separation of iron and zinc can be easily performed when a raw material contains iron.

According to the ninth aspect of the present invention, zinc contained in a raw material can be recovered as a manufactured product of a high market value.

According to the tenth aspect of the present invention, a high-quality zinc metal can be produced while influences of chlorine in electrolysis are suppressed.

According to the eleventh aspect of the present invention, alkali metal salt contained in an alkaline fluid can be circulated to be repeatedly used in a zinc dissolving step.

EMBODIMENT FOR CARRYING OUT THE INVENTION

A zinc recovery method according to the present embodiment includes a dissolving process of treating a raw material containing zinc with an alkaline fluid at a temperature equal to or higher than 100° C. to dissolve zinc contained in the raw material. Since zinc is extracted from the raw material in the dissolving process, zinc contained in a liquid phase can be recovered in a recovering process. In the present specification, zinc represents zinc (Zn) contained in metallic zinc, zinc ions, a zinc compound, a zinc alloy, or the like.

Figure 1:
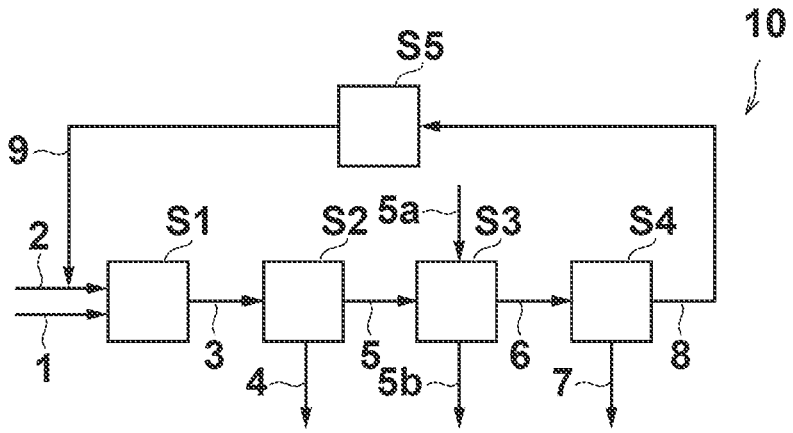
FIG. 1 is a configuration diagram schematically illustrating an outline of a zinc recovery method according to a first embodiment.

FIG. 1 schematically illustrates a recovery system 10 that recovers zinc contained in a raw material 1 as zinc metals 7 as a first embodiment.

The zinc recovery method of the first embodiment schematically includes a dissolving process S1 of dissolving zinc contained in the raw material 1 in an alkaline fluid 2, a solid-liquid separating process S2 of separating a product 3 obtained by the dissolving process S1 into a solid phase 4 and a liquid phase 5, an impurity removing process S3 of removing impurities 5*b* in the liquid phase 5, and an electrolyzing process S4 of electrolyzing a liquid phase 6 having been subjected to the impurity removing process S3 and containing zinc to obtain the zinc metals 7. A recovering process of zinc may include the solid-liquid separating process S2, the impurity removing process S3, and the electrolyzing process S4.

The raw material 1 containing zinc includes steelmaking dust such as blast furnace dust and electric arc furnace dust, iron scraps, zinc compounds, zinc concentrates, and the like. Forms of zinc contained in the raw material 1 include zinc compounds, metallic zinc, zinc alloys, and the like. The raw material 1 such as steelmaking dust and iron scraps contains zinc derived from zinc plating in addition to iron content. In the steelmaking dust, iron content and zinc have changed to oxide, hydroxide, zinc ferrite, or the like, by being subjected to a steelmaking process in some cases.

The zinc compounds that can be used as the raw material 1 include zinc oxide (oxide containing zinc), zinc hydroxide (hydroxide containing zinc), zinc carbonate (carbonate containing zinc), zinc chloride (chloride containing zinc), and the like. The zinc concentrates that can be used as the raw material 1 include ore obtained from oxide mineral, carbonate mineral, or the like of zinc and having a grade of zinc enhanced by mineral processing.

As described above, the raw material 1 may contain iron content. Forms of iron contained in the raw material 1 include iron compounds such as iron oxide and zinc ferrite, metallic iron, iron alloys, and the like. A compound containing zinc and iron as metals, such as zinc ferrite and composite oxide may be generated from zinc and iron in the raw material 1. The raw material 1 may contain iron content other than zinc ferrite. The ratio of zinc contained in the raw material 1 is, for example, about 10 to 40% by weight.

The raw material 1 may contain a metal other than zinc or non-metallic components as separation target components that are required to be separated from zinc. The metal other than zinc includes iron (Fe), lead (Pb), copper (Cu), cadmium (Cd), aluminum (Al), silicon (Si), and the like. The metal other than zinc may be contained as oxide, hydroxide, silicate, or the like in the raw material 1. It is preferable that the separation target components remain in the raw material 1 when zinc is dissolved from the raw material 1 into the alkaline fluid 2. It is also preferable that the separation target components dissolved in the alkaline fluid 2 are separated from zinc at the time of recovery of zinc.

Figure 2:
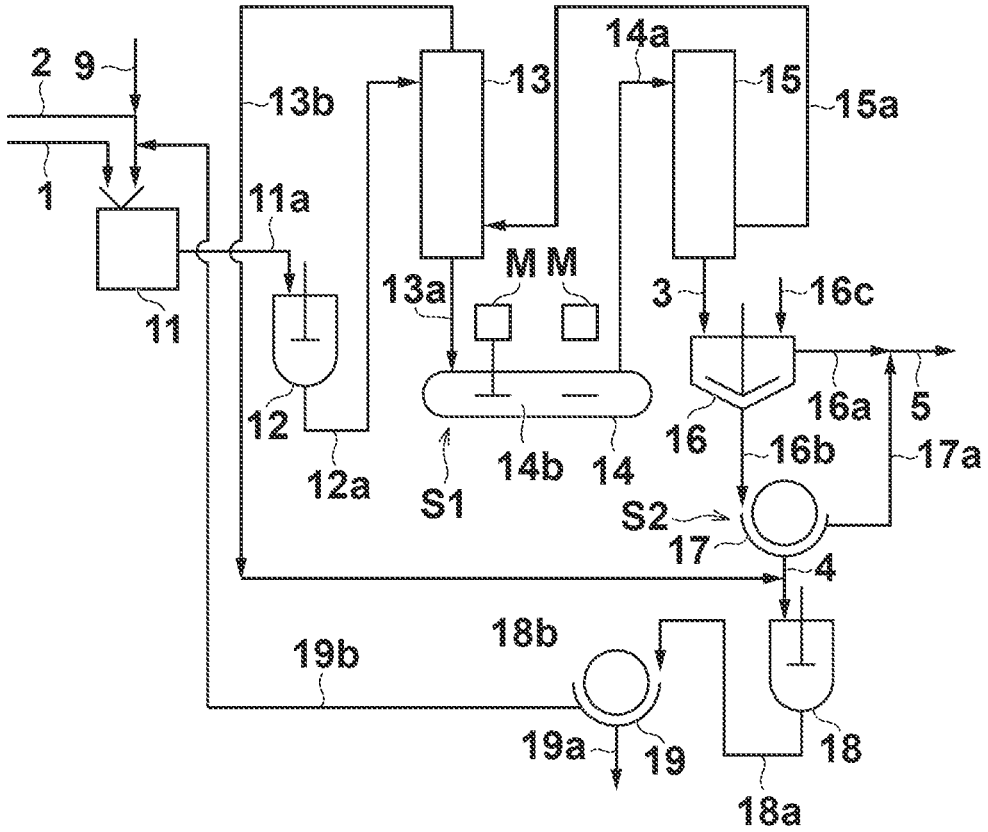
FIG. 2 is a configuration diagram illustrating an example of a system that performs a dissolving process and a solid-liquid separating process.

FIG. 2 illustrates an example of a system that performs the dissolving process S1 and the solid-liquid separating process S2. The raw material 1 and the alkaline fluid 2 may be separately supplied to the dissolving process S1. The raw material 1 and the alkaline fluid 2 may be supplied to the dissolving process S1 in a state mixed in advance. As the alkaline fluid 2, an aqueous solution, powder, a dispersion liquid, and the like of an alkaline compound are cited. For example, an aqueous solution in which the ratio of an alkaline compound contained in the alkaline fluid 2 is about 5 to 50% by weight may be used, or a dispersion in which the ratio thereof is about 50 to 80% by weight may be used.

The alkaline compound used in the dissolving process S1 includes alkali metal hydroxide such as sodium hydroxide (NaOH) and potassium hydroxide (KOH), and alkali metal carbonate such as sodium, carbonate ($Na_2CO_3$) and potassium carbonate ($K_2CO_3$). One type of alkaline compound can be used, or two or more types thereof may be used. In a case of using hydroxide, it is preferable to reduce carbon dioxide ($CO_2$) in gas (air, water vapor, or the like) that is brought in contact with the alkaline fluid 2 to suppress generation of carbonate.

In a case in which the raw material 1 contains bulky objects, it is preferable to supply small pieces, fine particles, and the like obtained by performing crushing, screening, or the like in advance, to the dissolving process S1. As crushing means, one type of a ball mill, a rod mill, a hammer mill, a fluid energy mill, a vibration mill, and the like, or two or more types thereof can be used although not particularly limited thereto.

In a case in which the particle surface of the raw material 1 is covered with a covering layer such as oxide or silicate, or a case in which a covering layer is generated on the particle surface when the raw material 1 is brought in contact with the alkaline fluid 2, it is preferable to break the covering layer. For example, the raw material 1 and the alkaline fluid 2 may be supplied to a pretreatment device 11 to treat the raw material 1 in the presence of the alkaline fluid 2. The pretreatment device 11 includes a wet grinder such as a mechanochemical treatment device using a ball mill. The temperature of the raw material 1 and the alkaline fluid 2 in the pretreatment device 11 may be ordinary temperatures at about 5 to 35° C. or may be heated to a temperature equal to or higher than the above temperatures.

A mixture 11*a* pretreated by the pretreatment device 11 contains the raw material 1 and the alkaline fluid 2. A slurry mixture 12*a* obtained by uniformly agitating the mixture 11*a* in a supply vessel 12 is pumped to a preheating device 13 using a pump (not illustrated) or the like. The alkaline fluid 2 may be further added to the mixture 11*a* between the pretreatment device 11 and the supply vessel 12. In a case in which the pretreatment device 11 is omitted, the raw material 1 and the alkaline fluid 2 may be supplied directly to the supply vessel 12.

In the preheating device 13, the mixture 12*a* is heated by being brought in contact with water vapor 15*a*. This enables the mixture 12*a* to be efficiently heated even when the mixture 12*a* is thick and has a high viscosity. The heating method for the mixture 12*a* is not particularly limited to that described above, and an internal-combustion engine, power, solar heat, or the like may be used.

A mixture 13*a* that has been heated to a high temperature by the preheating device 13 is supplied to a reaction vessel 14. In the reaction vessel 14, a mixture 14*b* being reacting is agitated using an agitation device using a motor M, or the like. By treating zinc contained in the raw material 1 in the solid phase with the high-temperature alkaline fluid 2, zinc can be dissolved in the liquid phase. As the heating method for the mixture 14*b*, water vapor, an internal-combustion engine, power, solar heat, or the like can be used although not particularly limited thereto. Examples of the concentration of an alkaline compound contained in the mixture 14*b* are about 5 to 80% by weight. The temperature of the alkaline fluid 2 to be used in the dissolving process S1 or the temperature of the mixture 14*b* being reacting is preferably 95° C. or higher, and more preferably 100° C. or higher.

Since zinc is an amphoteric metal, zinc contained in the raw material 1 is soluble in the alkaline fluid 2. Iron oxide and the like in iron content are hardly soluble in the alkaline fluid 2. While known as being hardly soluble, zinc ferrite is easily dissolved by being brought in contact with the high-temperature alkaline fluid 2. This enables zinc in the raw material 1 to be effectively dissolved. While aluminum (Al) is also an amphoteric metal, alumina ($Al_2O_3$) has a high crystallizability and is resistant to alkali.

The dissolving process S1 may be performed in atmospheric pressure. In this case, the present embodiment is applicable to a device with an inner part that is open to the atmosphere, and facilities can be more simplified. Examples of the treatment temperature in the case in which the dissolving process S1 is performed in atmospheric pressure are 100 to 200° C. To raise the treatment temperature to be higher than the boiling point (100° C.) of water in atmospheric pressure, it is preferable to increase the concentration of the alkaline compound contained in the mixture 14*b* being reacting. For example, the boiling point of an NaOH aqueous solution at 50% by weight is 130 to 135° C.

When an autoclave or the like is used as the reaction vessel 14, the dissolving process S1 can be performed under a pressurized condition. In this case, boiling of moisture can be suppressed and the high-temperature alkaline fluid can be stably handled. Examples of the treatment temperature in the case in which the dissolving process S1 is performed under a pressurized condition are 105 to 220° C. It is preferable that the pressure under the pressurized condition is higher than the atmospheric pressure by 0.017 MPa to 2 MPa.

It is said that zinc ferrite denatures at temperatures equal to or higher than 252° C. when the raw material 1 contains zinc ferrite. Therefore, the treatment temperature in the dissolving process S1 is preferably a temperature equal to or lower than 252° C. By retaining the mixture 14*b* containing the raw material 1 and the alkaline fluid 2 for a certain time in the reaction vessel 14, the temperature of the mixture 14*b* is maintained at the treatment temperature described above.

To retain the mixture 14*b* being reacting in the reaction vessel 14 while maintaining a predetermined reaction condition, the reaction vessel 14 may gradually move the mixture 14*b* from the entrance toward the exit. The reaction vessel 14 may have a shape in which the dimension along the moving direction is larger than that in a direction crossing the moving direction. To control the movement speed of the mixture 14*b*, a mechanism that suppresses or promotes the movement may be installed in the moving direction. The mechanism that controls the movement is installed at, for example, a place where the sectional area with respect to the moving direction decreases or increases.

When the inside of the reaction vessel 14 is pressurized to a pressure higher than the atmospheric pressure, a reacted mixture 14*a* having been subjected to the dissolving process S1 in the reaction vessel 14 is transferred to a step-down device 15 such as a flash vessel. When the pressure of the mixture 14*a* heated to a temperature equal to or higher than 100° C. is stepped down by the step-down device 15, moisture contained in the mixture 14*a* vaporizes and the water vapor 15*a* is generated. After the water vapor 15*a* is separated from the product 3 in the step-down device 15, the product 3 is sent to the solid-liquid separating process S2. It is also possible to use the water vapor 15*a* separated by the step-down device 15 as a heat source of the preheating device 13.

When the product 3 of the dissolving process S1 is slurry, iron content and the like are contained in the solid phase and zinc dissolved in alkali is contained in the liquid phase. Therefore, with separation of the solid phase and the liquid phase, iron content and zinc can be easily separated from each other. As the method for the solid-liquid separation, one type of filtration, centrifugation, sedimentation separation, and the like, or two or more thereof are used although not particularly limited thereto. In the filtration, methods for filtration include gravity filtration, filtration under reduced pressure, filtration under pressure, centrifugal filtration, filter aid-added filtration, and press and squeeze filtration although not particularly limited thereto. The solid-liquid separation by filtration or the like may be of a continuous type or a batch type.

In the solid-liquid separating process S2, for example, after the product 3 is transferred to a settling tank 16, and a precipitant 16*c* is added thereto, the resultant is agitated and is left to stand or the like, so that a supernatant 16*a* and a precipitate 16*b* can be separated from each other. To promote deposition of the precipitate 16*b* containing iron, chromium, manganese, and the like, an aeration process to blow air into the product 3 may be performed. With an oxidation reaction using oxygen ($O_2$), separation of the precipitate 16*b* can be facilitated while the alkaline property of the product 3 is maintained. A filtering device 17 such as a rotating filter may be used to separate the liquid phase contained in the precipitate 16*b*. The liquid phase 5 including the supernatant 16*a* obtained by the settling tank 16 and a filtrate 17*a* obtained by the filtering device 17 is recovered as a phase containing zinc.

Since the solid phase 4 separated from the liquid phase 5 by the settling tank 16 and the filtering device 17 contains resources such as iron oxide, the solid phase 4 may be washed with water or the like. After the solid phase 4 is dispersed into washing water 18*b* in a washing tank 18, resultant slurry 18*a* is transferred to a dehydrating device 19 and residues 19*a* in the solid phase can be separated from an aqueous phase 19*b*. Silica, alumina, and the like are removed as the residues 19*a*.

Since the aqueous phase 19*b* is alkaline, the aqueous phase 19*b* may be added to the alkaline fluid 2 after concentrated as required. When the residues 19*a* contain a large amount of iron content such as iron oxide, the residues 19*a* can be used as an iron-making material in an electric arc furnace or the like. A liquid obtained by condensing vapor 13*b* recovered from the preheating device 13 may be used as the washing water 18*b*. At the time of condensing the vapor 13*b*, thermal energy may be recovered using a heat exchanger such as a condenser.

As described above, the liquid phase 5 separated from the solid phase 4 in the solid-liquid separating process S2 contains zinc. Therefore, as illustrated in FIG. 1, the zinc metals 7 can be obtained by depositing metallic zinc by electrolysis such as electrowinning (EW) or electrolytic purification (ER) in the electrolyzing process S4. It is preferable that a remover 5*a* is added to the liquid phase 5 to remove impurities 5*b* as an impurity removing process S3 prior to the electrolyzing process S4 because the quality of the zinc metals 7 can be improved.

When the impurities 5*b* contain a heavy metal such as lead (Pb) ions, a sulfurizing agent such as sodium sulfide ($Na_2S$), sodium hydrosulfide (NaSH), or sodium tetrasulfide ($Na_2S_4$) may be used as the remover. This enables lead (Pb), copper (Cu), cadmium (Cd), mercury (Hg), and the like to precipitate as sulfide.

By adding metallic zinc (Zn) as the remover 5*a* to the liquid phase 5, ions of metals having a smaller ionization tendency than zinc can be reduced to be substituted and deposited. Zinc ions generated from the metallic zinc (Zn) by substitution and deposition are dissolved in the liquid phase 6 similarly to zinc contained in the raw material. When metallic zinc is used as the remover 5*a*, a small amount of metallic zinc corresponding to the amount of the impurities 5*b* suffices and accordingly a part of metallic zinc recovered by the electrolyzing process S4 can also be used as the remover 5*a* by substitution.

In the electrolyzing process S4, the zinc metals 7 can be obtained by performing electrolysis using the liquid phase 6 having been subjected to the impurity removing process S3 as an electrolytic bath. In a case in which metallic zinc is won or purified by electrolysis, it is preferable to use stainless steel as an anode and a cathode. This enables corrosion of the electrodes to be suppressed even when the liquid phase 6 used as the electrolytic bath at the time of electrolysis is strongly alkaline. The shapes of the electrodes can be, for example, a flat plate shape although not particularly limited thereto.

When chlorine (Cl) is also contained in the liquid phase 6, there is a risk that the chlorine (Cl) becomes anions such as $Cl^-$ or $ClO^-$ and interferes with deposition of metallic zinc on the electrode (the cathode). Therefore, it is preferable that the chlorine concentration in the liquid phase 6 is low and the chlorine concentration is preferably equal to or lower than 1000 ppm. This enables influences of chlorine in the electrolysis to be suppressed, whereby metallic zinc can be deposited to have a foil shape, a plate shape, or the like on the electrode, and the zinc metals 7 of a high quality can be produced. It is to be noted that ppm can be represented by mg/l.

To obtain smooth and high-quality metals, an additive that is normally used in electrolytic purification or electrowinning of zinc, or electrogalvanizing may also be used. An alkaline zinc plating bath is known as a zincate bath and an additive for plating such as so-called a brightening agent, an inhibiter, or an accelerator may be used. Thiourea and polyalkylamine are cited as examples of the additive.

As the method for decreasing the chlorine concentration in the liquid phase 6, there are a method of adding an acid to the liquid phase 6 to be acidulated and volatilizing chlorine gas ($Cl_2$), a method of adding an organic substance to the liquid phase 6 and volatilizing a volatile organic chlorine compound such as chloroform ($CHCl_3$), a method of adsorbing $Cl^-$ onto an anion-exchange resin to be substituted by $OH^-$, a method of adding silver salt such as silver nitrate and precipitating silver chloride (AgCl), and the like.

When the raw material 1 contains an organic halogen compound, the organic halogen compound can be decomposed with the alkaline fluid 2 at a high temperature in the dissolving process S1. Accordingly, the organic halogen compound contained as impurities in steelmaking dust or the like can be decomposed and detoxified. However, halogens such as chlorine and bromine generated by the decomposition of the organic halogen compound, or halogens derived from inorganic halogen compounds are less likely to volatilize in an alkaline condition and are likely to remain in the liquid phases 5 and 6. Therefore, it is preferable to discharge halogens out of the system prior to the electrolyzing process S4. This enables metallic zinc to be produced while suppressing influences of halogens in the electrolysis.

Figure 3:
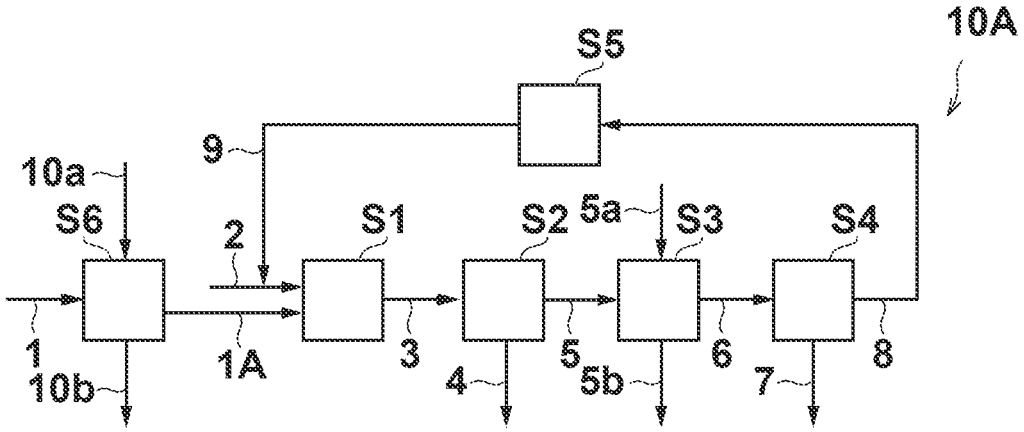
FIG. 3 is a configuration diagram schematically illustrating an outline of a zinc recovery method according to a second embodiment.

FIG. 3 schematically illustrates a case in which an alkali washing process S6 to remove halogen compounds from the raw material 1 is performed in a recovery system 10A that recovers zinc contained in the raw material 1 as the zinc metals 7 as a second embodiment. The same processes as those in the first embodiment can be performed in the dissolving process S1, the solid-liquid separating process S2, the impurity removing process S3, the electrolyzing process S4, and the reproducing process S5 in the second embodiment.

As a method of discharging halogens out of the system prior to the dissolving process S1, the alkali washing process S6 of washing the raw material 1 with an alkali aqueous solution is cited. While washing with neutral water does not have a sufficient washing effect, a sufficient halogen removing effect is obtained when the raw material 1 is washed with an alkali aqueous solution 10*a* at about 0.1 to 20% by weight. Although the reason why halogen compounds in the raw material 1 are less soluble in neutral water is not clear, it is presumed that this is because the halogen compounds exist as inorganic halogen compounds such as aluminum chloride or copper oxychloride.

In the alkali washing process S6, after the raw material 1 and the alkali aqueous solution 10*a* are mixed, an alkali washing liquid 10*b* is separated from a raw material 1A, whereby halogen compounds in the raw material 1 are removed into the alkali washing liquid 10*b*. This can decrease the halogen concentration in the raw material 1A after the washing. The alkali washing liquid 10*b* contains soluble components such as the halogen compounds derived from the raw material 1 in addition to alkali content derived from the alkali aqueous solution 10*a*. Influences of the halogen compounds in the electrolyzing process S4 can be suppressed by washing and removing the halogen compounds in the state of the raw material 1.

Alkaline compounds to be used for the alkali aqueous solution 10*a* in the alkali washing process S6 include alkali metal hydroxide such as sodium hydroxide (NaOH) and potassium hydroxide (KOH), and alkali metal carbonate such as sodium carbonate ($Na_2CO_3$) and potassium carbonate ($K_2CO_3$). The concentration of the alkali aqueous solution 10*a* used in the alkali washing process S6 may be lower than the concentration of the alkaline fluid 2 used in the dissolving process S1. The concentration of the alkali aqueous solution 10*a* may be, for example, equal to or lower than 10% by weight, or equal to or lower than 5% by weight. The concentration of the alkaline fluid 2 can be, for example, equal to or higher than 5% by weight, or equal to or higher than 10% by weight.

The use of the alkali aqueous solution 10*a* at a low concentration in the alkali washing process S6 can suppress elution of zinc into the alkali washing liquid 10*b*. Zinc dissolved in the alkali washing liquid 10*b* can be recovered as zinc carbonate in a carbonating process S7 described later.

Also in the course of alkali leaching at a high temperature in the dissolving process S1, at least some of halogens can be volatilized. Volatilization of halogens can be promoted when an organic substance such as a small amount of alcohol is also mixed in the mixture 14*b* being reacting. It is presumed that this is because heavy metals in the raw material 1 catalytically function to generate low-boiling and hydrophobic volatile organic chlorine compounds although the reason is not clear. To remove halogens in the dissolving process S1, a mechanism to discharge volatile components liberated from the mixture 14*b* being reacting from the reaction vessel 14 to outside the system and remove the volatile components may be installed.

In the first embodiment illustrated in FIG. 1 or the second embodiment illustrated in FIG. 3, a residual liquid 8 such as a tailing electrolyte having been subjected to the electrolyzing process S4 contains alkali metal salt. When the residual liquid 8 is alkaline, the residual liquid 8 can be used in the dissolving process S1 as the alkaline fluid 2. When the alkali concentration in the residual liquid 8 is insufficient, it is preferable to perform the reproducing process S5 to increase the alkali concentration by electrolysis, concentration, or the like. By supplying an alkaline fluid 9 reproduced in the producing process S5 to the dissolving process S1 along with the alkaline fluid 2 newly supplied, the alkali metal salt can be circulated to be repeatedly used in the dissolving process S1. Both electrolysis and concentration can be performed in the reproducing process S5.

When electrolysis is used in the reproducing process S5, it is preferable to place a barrier membrane such as an ion-exchange membrane between the cathode and the anode to divide an electrolytic cell into a cathode chamber on the cathode side and an anode chamber on the anode side. A specific example of the ion-exchange membrane is a cation-exchange membrane such as a fluorine-containing polymetric membrane having a functional group that provides anions, such as carboxylic acid or sulfonic acid.

When the residual liquid 8 is supplied to the anode chamber to progress electrolysis, impurities in the residual liquid 8 precipitate as metallic hydroxide or the like, or remains as complex anions in the anode chamber. Since alkali metals move to the cathode chamber while remaining in cations, a catholyte obtained in the cathode chamber contains less impurities and becomes an alkali metal hydroxide aqueous solution at a high concentration. Accordingly, the catholyte can be used as the reproduced alkaline fluid 9. In the reproducing process S5, the electrolysis may be repeated two or more times.

When concentration is used in the reproducing process S5, moisture contained in the residual liquid 8 can be vaporized, for example, by forming a liquid film of the residual liquid 8 on the surface of a heater. Accordingly, the alkali aqueous solution can be concentrated and can be used as the reproduced alkaline fluid 9. It is preferable that nickel, stainless steel, or the like as a metal having a high corrosion resistance to the alkali aqueous solution at a high concentration is used for a material of the heater or the like in a concentrating device. In the reproducing process S5, the concentration may be repeated two or more times.

Figure 4:
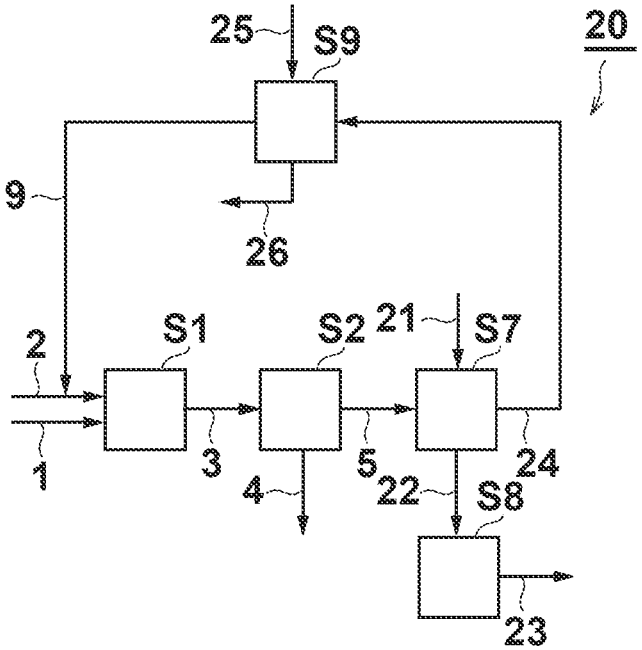
FIG. 4 is a configuration diagram schematically illustrating an outline of a zinc recovery method according to a third embodiment.

Next, as illustrated in FIG. 4, a recovery system 20 that recovers zinc contained in the raw material 1 as zinc carbonate 22 or zinc oxide 23 is explained as a third embodiment.

A zinc recovery method of the third embodiment schematically includes the dissolving process S1 of dissolving zinc contained in the raw material 1 into the alkaline fluid 2, the solid-liquid separating process S2 of separating the product 3 obtained by the dissolving process S1 into the solid phase 4 and the liquid phase 5, the carbonating process S7 of transforming zinc in the liquid phase 5 into the zinc carbonate 22, and a thermally treating process S8 of transforming the zinc carbonate 22 into the zinc oxide 23. A recovering process of zinc may include the solid-liquid separating process S2, the carbonating process S7, and the thermally treating process S8.

The same processes as those explained with reference to FIG. 2 in the first embodiment can be performed in the dissolving process S1 and the solid-liquid separating process S2. Therefore, redundant explanations are omitted.

In the carbonating process S7, a carbonation agent 21 such as carbon dioxide ($CO_2$) is supplied to the liquid phase 5 to precipitate zinc in the liquid phase 5 as the zinc carbonate 22. Also in the third embodiment, the impurity removing process S3 may be performed similarly to the first embodiment. In this case, the carbonating process S7 can be performed by adding the carbonation agent 21 to the liquid phase 6 from which the impurities 5*b* have been removed as described above. As the method of separating the precipitate of the zinc carbonate 22 from the liquid phase in the carbonating process S7, one type of filtration, centrifugation, sedimentation separation, and the like, or two or more thereof can be used although not particularly limited thereto. The zinc carbonate 22 can be zinc carbonate ($ZnCO_3$) being normal salt or can be basic zinc carbonate including $OH^-$.

In the thermally treating process S8, the zinc oxide 23 as well as $CO_2$ can be obtained by thermally decomposing the zinc carbonate 22. $CO_2$ generated by the thermal decomposition of the zinc carbonate 22 can be reused as the carbonation agent 21 in the carbonating process S7. As the method of recovering $CO_2$, an amine-based absorbent being a basic organic compound may be used although not particularly limited thereto. When a gas containing $CO_2$ is passed through an amine-based solution, $CO_2$ is absorbed into the amine-based solution. When the amine-based solution having absorbed $CO_2$ is heated, $CO_2$ is released into the gas phase.

Residues 24 separated from the zinc carbonate 22 in the carbonating process S7 sometimes contain excessive $CO_2$ and has an acidity. To reproduce the alkaline fluid 9 from the residues 24, an alkalinizing process S9 of adding an alkalinization agent 25 to the residues 24 may be performed. The alkalinization agent 25 includes hydroxide or oxide of an alkaline earth metal, for example, $Ca(OH)_2$ or CaO. This causes the excessive $CO_2$ to precipitate as carbonate of the alkaline earth metal, or the like. A carbonate precipitate 26 can be removed from, the alkaline liquid phase by filtration, centrifugation, sedimentation separation, or the like.

The alkaline fluid 9 reproduced by removing the carbonate precipitate 26 in the carbonating process S7 can be used in the dissolving process S1. When the alkali concentration of the reproduced alkaline fluid 9 is insufficient, the reproducing process S5 of increasing the alkali concentration by electrolysis, concentration, or the like may be performed in the same manner as in the first or second embodiment. By supplying the reproduced alkaline fluid 9 along with the newly-supplied alkaline fluid 2 to the dissolving process S1, alkali metal salt can be circulated to be repeatedly used in the dissolving process S1.

According to the recovery systems 10, 10A, and 20 of the embodiments, zinc contained in the raw material 1 can be recovered as a manufactured product of a high market value, such as the zinc metals 7, the zinc oxide 23, or the zinc carbonate 22.

Figure 5:
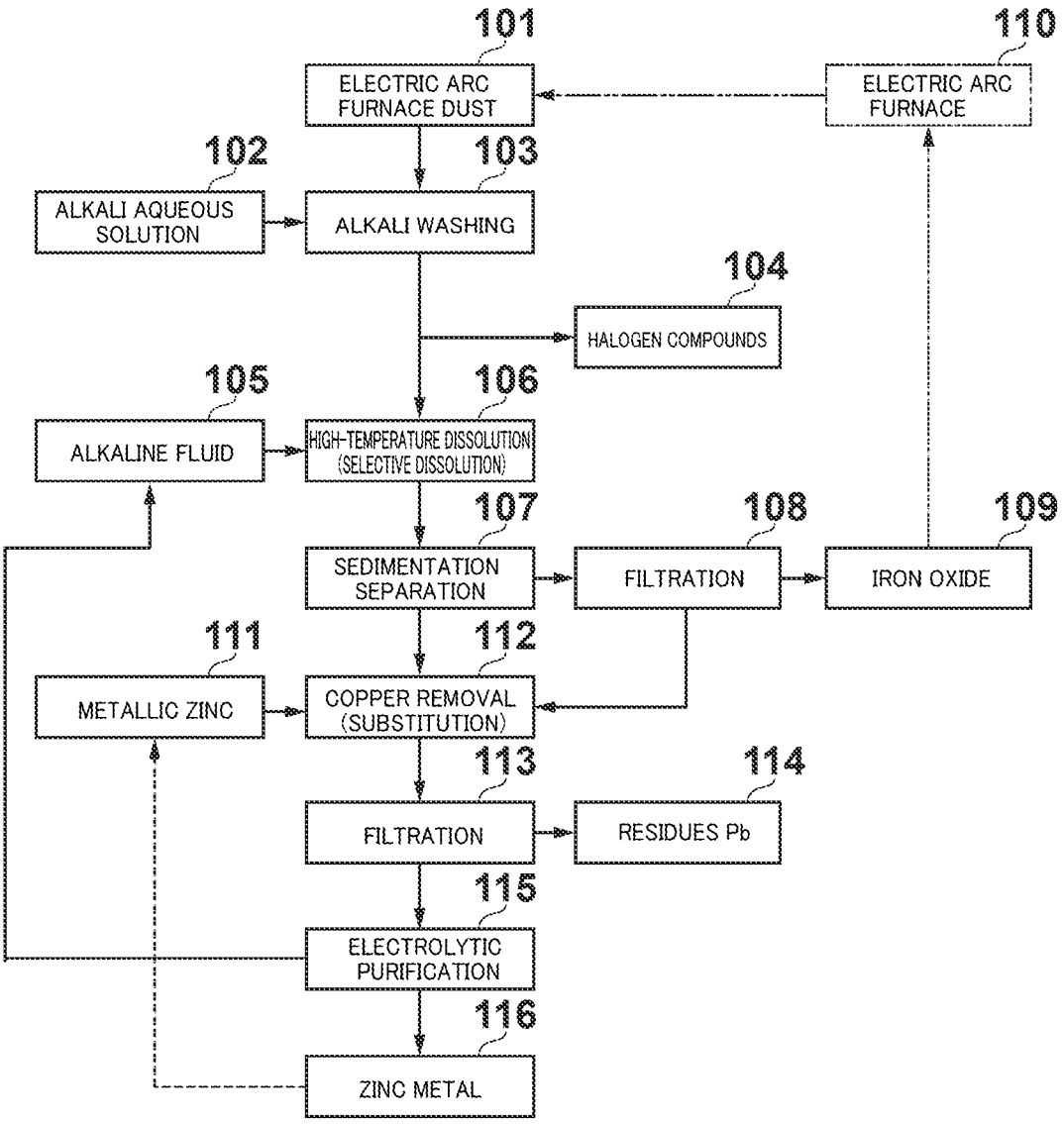
FIG. 5 is a flowchart illustrating a specific example of a method of recovering zinc as zinc metals.

A specific example of the preferred embodiments includes processes illustrated in the flowchart of FIG. 5.

(1) Alkali Washing Process S6 Described above:

Halogen compounds 104 are removed by alkali washing 103 of washing electric arc furnace dust 101 with an alkali aqueous solution 102.

(2) Dissolving Process S1 Described above:

The electric arc furnace dust 101 having been subjected to the alkali washing 103 is brought in contact with a high-temperature alkaline fluid 105 to perform high-temperature dissolution 106. In the high-temperature dissolution 106, zinc is selectively dissolved.

(3) Solid-Liquid Separating Process S2 Described above:

A product of the high-temperature dissolution 106 is treated by sedimentation separation 107. The sedimentation separation 107 may separate a major part of a supernatant solution and leave a small amount of liquid in the precipitate as in a sedimentation thickening device (a thickener). The precipitate obtained by the sedimentation separation 107 is washed with water, and a precipitate of iron oxide 109 is obtained by filtration 108. The iron oxide 109 can be input to an electric arc furnace 110 as an iron-making raw material.

(4) Impurity Removing Process S3 Described above:

A liquid phase obtained by the sedimentation separation 107 and a washing liquid obtained by the filtration 108 are mixed, metallic zinc 111 is added thereto, and copper removal (substitution) 112 is performed. By filtration 113 of the generated precipitate, residues 114 containing copper are obtained. A residual liquid obtained by the filtration 113 contains zinc dissolved by alkali leaching.

(5) Electrolyzing Process S4 Described above:

Zinc metals 116 are produced by electrolytic purification 115 of a liquid phase from which copper has been removed by the filtration 113. Some of the zinc metals 116 can be used as the metallic zinc 111 in the copper removal (substitution) 112.

(6) Reproducing Process S5 Described above:

An alkaline fluid 105 can be reproduced from a tailing electrolyte obtained by the electrolytic purification 115.

While the present invention has been explained above based on preferred embodiments, the present invention is not limited to the above embodiments and various modifications may be made without departing from the scope of the present invention. Addition, substitution, omission, and other changes in the constituent elements of the respective embodiments are included in the modifications. Further, constituent elements used in different embodiments may be appropriately combined with one another.

For example, the zinc metals 7 can be produced using a liquid, which is obtained by dissolving the zinc carbonate 22 or the zinc oxide 23 recovered using the recovery system 20 of the third embodiment into an alkaline fluid, as an electrolytic bath in the electrolyzing process S4 of the first or second embodiment. The zinc metals 7 of a higher quality can be obtained by performing electrolysis after the zinc carbonate 22 or the zinc oxide 23 is recovered. The electrolyzing process S4 may be performed after the solution of the zinc carbonate 22 or the zinc oxide 23 is treated by the impurity removing process S3.

EXAMPLES

The present invention will be explained below in detail with experimental examples.

<Electric Arc Furnace Dust>

The ratios (% by weight) of main metals contained in electric arc furnace dust that was used in first to fifth experimental examples were as follows.

Na: ND, Mg: 0.544, Al: 0.180, K: 0.883, Ca: 16.985, Cr: 0.152, Mn: 1.081, Fe: 13.327, Ni: 0.014, Cu: 0.214, Cd: 0.115, Sn: ND, Pb: 0.096, Zn: 30.500

First Experimental Example

[Zinc Extracting Process]

Calcium carbonate of 441 g and electric arc furnace dust of 762.8 g were mixed and calcinated, so that secondary dust (A10) of 870 g was obtained. After 60.5 g was sorted from the secondary dust (A10) and was brought in contact with an NaOH aqueous solution at a concentration of 16.5%, solid content (A11) insoluble in NaOH was separated by filtration and a zinc extract (B11) of 395 ml was obtained. Assuming a case of further extracting extractable components remaining in the solid content (A11), the solid content (A11) was brought in contact with 866 ml of an NaOH aqueous solution at 16.5%, and unwashed residues (A12) and a filtrate (B12) were separated by filtration. After the unwashed residues (A12) were washed with pure water, the resultant was filtered and residues (A13) with a dry weight of 43.3 g were obtained. At the time of bringing the secondary dust (A10) and the solid content (A11) in contact with the NaOH aqueous solution, the temperature was set to 95° C., the pressure was ordinary pressure, and each contact time was eight hours.

[Zinc Carbonate Separating Process]

$CO_2$ was blown into the zinc extract (B11), a precipitate (P11) containing zinc carbonate was deposited, and the precipitate (P11) was separated from a filtrate (Q11) by suction filtration using a glass fiber/C filter paper as a filter medium. The obtained precipitate (P11) weighing 22.1 g was handled as a manufactured product.

[Supplement]

A washing water (B13) obtained as a filtrate when the residues (A13) were washed with pure water can be repeatedly used as dilution water. While containing $Na_2CO_3$ and $NaHCO_3$, the filtrate (Q11) obtained by separation of the precipitate (P11) through filtration is alkaline and can accordingly be repeatedly used as an alkaline solution for extracting zinc from dust. In this case, when the residues (A13) are brought in contact with the filtrate (Q11), $Na_2CO_3$ and $NaHCO_3$ can be transformed into NaO by CaO contained in the residues (A13).

[Analysis of Extract]

The following is a result of an analysis on the concentrations (mg/l) of major components contained in the zinc extract (B11).

Na: 80120, Mg: 0.1, Al: 122, K: 4750, Ca: 30, Cr: 398, Mn: less than 0.3, Fe: 3, Ni: less than 1, Cu: 10, Cd: less than 0.6, Sn: less than 15, Pb: 91, Zn: 43000

[Analysis of Residues]

The following is a result of an analysis on the ratios (% by weight) of major components contained in the residues (A13).

Na: 0.51, Mg: 0.76, Al: 0.15, Ca: 23.7, Cr: 0.04, Mn: 1.51, Fe: 18.61, Ni: 0.02, Cu: 0.25, Cd: 0.16, Zn: 3.37

[Analysis of Manufactured Product]

The following is a result of an analysis on the ratios (% by weight) of major components contained in the precipitate (P11) handled as a manufactured product.

Na: less than 2, Mg: 0.00086, Al: less than 0.2, K: less than 10, Ca: 0.71, Cr: less than 0.03, Mn: less than 0.03, Fe: less than 0.03, Ni: less than 0.05, Cu: less than 0.2, Cd: less than 0.05, Sn: less than 1, Pb: less than 0.05, Zn: 77.0

[Extraction Result]

Zn contained in 60.5 g of the secondary dust (A10) was calculated to be about 18.45 g, Zn contained in 395 ml of the zinc extract (B11) to be about 16.98 g, Zn contained in 43.3 g of the residues (A13) to be about 1.46 g, and Zn contained in 22.1 g of the precipitate (P11) to be about 17.01 g. It is considered that a substantially entire amount of Zn contained in the zinc extract (B11) was recovered as the precipitate (P11) of zinc carbonate.

Second Experimental Example

[Zinc Extracting Process]

Calcium carbonate of 441 g and electric arc furnace dust of 762.8 g were mixed and calcinated, so that secondary dust (A20) of 870 g was obtained. After 60.5 g was sorted from the secondary dust (A20) and was brought in contact with 1000 g of an NaOH aqueous solution at a concentration of 16.5%, solid content (A21) insoluble in NaOH was separated by filtration. Furthermore, the ratio of solid content in a leachate was adjusted to obtain a chlorine concentration of 480 mg/l, and a zinc extract (B21) of 770 ml was obtained. The solid content (A21) insoluble in the NaOH aqueous solution was washed with pure water and was subsequently filtered, so that residues (A22) with a dry weight of 46.2 g were obtained. At the time of bringing the secondary dust (A20) in contact with the NaOH aqueous solution, the temperature was set to 95° C., the pressure was ordinary pressure, and the contact time was eight hours.

[Electrolyzing Process]

The zinc extract (B21) was electrolyzed and 8.7 g of metallic zinc (P21) in a smooth foil shape was obtained. As the electrolysis conditions, the constant current was 1A, a cathode and an anode as electrodes were both SUS304 (flat plates having a thickness of 1 ram and a dimension in a liquid being 20 mm in width and 80 ram in height), the distance between the electrodes was 20 mm, the current density of a geometric area criterion was 62.5 $mA/cm^2$, the electrolysis time was 8.5 hours, and the Zn deposition current efficiency was 84%.

[Supplement]

Since a tailing electrolyte (Q21) remaining after the metallic zinc (P21) is extracted from the zinc extract (B21) in the electrolyzing process is alkaline, the tailing electrolyte (Q21) can be repeatedly used in the zinc extracting process.

[Analysis of Extract]

The following is a result of an analysis on the concentrations (mg/l) of major components contained in the zinc extract (B21).

Na: 82758, Mg: less than 0.1, Al: 51, K: 628, Ca: 17, Cr: 88, Mn: less than 0.5, Fe: 6, Ni: less than 1, Cu: less than 25, Cd: less than 1, Sn: less than 15, Pb: 68, Zn: 19961, Cl: 480

[Analysis of Residues]

The following is a result of an analysis on the ratios (% by weight) of major components contained in the residues (A22).

Na: less than 0.1, Mg: 0.051, Al: 0.3, K: less than 0.6, Ca: less than 0.001, Cr: 0.08, Mn: 1.7, Fe: 22, Ni: 0.02, Cu: 0.1, Cd: 0.05, Sn: less than 0.5, Pb: 0.6, Zn: 6.9

[Extraction Result]

Zn contained in 60.5 g of the secondary dust (A20) was about 18.45 g, Zn contained in 770 ml of the zinc extract (B21) was about 15.37 g, Zn contained in 46.2 g of the residues (A22) was about 3.19 g, the metallic zinc (P21) obtained by the electrolysis was 8.7 g, and Zn contained in 750 ml of the tailing electrolyte (Q21) was about 6.6 g. The Zn concentration of the tailing electrolyte (Q21) was 8850 mg/l.

Third Experimental Example

[Secondary Dust (A30)]

Secondary dust (A30) obtained from the electric arc furnace dust can be the secondary dust (A10) in the first experimental example or the secondary dust (A20) in the second experimental example, and the following is a result of an analysis on the ratios (weight %) of major components contained in the secondary dust (A30).

Na: 0.22, Mg: 2.29, Al: 0.32, K: less than 500, Ca: 1.55, Cr: less than 3, Mn: 0.59, Fe: 0.13, Ni: 0.51, Cu: 0.77, Cd: 0.03, Sn: less than 50, Pb: 0.14, Zn: 29.05, Cl: 4.91

[Leaching Process]

After 100 g of the secondary dust (A30) was added to an NaOH aqueous solution at a concentration of 16.5% in a beaker and the resultant was agitated, dead-end filtration was performed and solid content (A31) and an extract (B31) were obtained. After the solid content (A31) was added to a new NaOH aqueous solution at 16.5% and was repulped, dead-end filtration was performed and a zinc extract (B32) and residues (A32) were obtained. The secondary dust (A30) was further added to the zinc extract (B32) being a filtrate to repeat leaching. The following is a result of an analysis on the concentrations (mg/l) of major components contained in a leachate (B33) finally obtained.

Na: 101000, Mg: less than 1, Al: 32, K: 232, Ca: 2, Cr: less than 10, Mn: less than 10, Fe: less than 20, Ni: less than 20, Cu: 951, Cd: less than 10, Sn: less than 50, Pb: 3750, Zn: 45800

[Analysis of Leaching Residues]

The following is a result of an analysis on the ratios (% by weight) of major components contained in leaching residues (A33) obtained by separation from the leachate (B33).

Na: less than 0.08, Mg: 2.12, Al: 0.23, K: less than 0.6, Ca: 1.32, Cr: 0.001, Mn: 0.53, Fe: 0.13, Ni: 0.49, Cu: 0.20, Cd: 0.03, Sn: less than 0.008, Pb: 0.09, Zn: 0.88

[Substituting Process]

It was found from the result of the leaching process that Pb and Cu as well as Zn are also leached at the significant ratios in the leachate (B33). Accordingly, after metallic zinc particles having an average particle diameter of 5 mm were added to the leachate (B33) and substitution (cementation) was performed, dead-end filtration was performed. Since metallic powder was obtained by the cementation, it was found that Cu and Pb can be separately recovered. The following is a result of an analysis on the concentrations (mg/l) of major components contained in a leachate (B34) after the cementation.

Na: 100857, Mg: less than 0.1, Al: 24, K: less than 120, Ca: 2, Cr: less than 0.5, Mn: 1, Fe: less than 2, Ni: less than 2, Cu: less than 4, Cd: less than 1, Sn: less than 10, Pb: less than 2, Zn: 51514, Cl: 9400

[Zinc Carbonate Separating Process]

$Co_2$ gas was blown into the leachate (B34) after the cementation, and zinc carbonate (P31) was deposited and was won by filtration. The following is a result of an analysis on the ratios (% by weight) of major components contained in the obtained zinc carbonate (P31).

Na: 0.49, Mg: 0.00016, Al: less than 0.0003, K: less than 0.02, Ca: less than 0.0025, Cr: 0.00007, Mn: 0.00005, Fe: less than 0.0002, Ni: less than 0.0002, Cu: less than 0.0004, Cd: less than 0.00001, Sn: less than 0.001, Pb: 0.0002, Zn: 59.9, Cl: 0.29

[Analysis of Leachate after Winning of Zinc Carbonate]

The following is a result of an analysis on the concentrations (mg/l) of major components contained in a leachate (B35) after the zinc carbonate (P31) was won.

Na: 102462, Mg: less than 1, Al: less than 20, K: 1172, Ca: 2, Cr: less than 2, Mn: less than 0.7, Fe: less than 10, Ni: less than 7, Cu: less than 20, Cd: less than 0.2, Sn: less than 30, Pb: 14, Zn: 6978

[Supplement]

By depositing the zinc carbonate (P31) after Cu and Pb are removed by cementation, zinc carbonate having a high purity can be obtained. By bringing $Na_2CO_3$ and $NaHCO_3$ that are generated as by-products in the leachate (B35) after blow-in of the $CO_2$ gas in contact with the residues (A32) that have $Ca(OH)_2$ contained in the secondary dust (A30) as a main component, NaOH can be reproduced. $CO_2$ gas can be collected in the zinc carbonate separating process as $CO_2$ to be used in the zinc carbonate separating process. Theoretically, Na content and $CO_2$ can be reused without consumption of a chemical. Ni of the undissolved residues (A32) in the leaching process can be electrolytically recovered by the cathode, and Mn can be recovered by the anode. When the electrolyzing process is adopted, chlorine can also be volatilized as chlorin gas by pH adjustment, or as a volatile organic chlorine compound such as chloroform by causing an organic substance to exist together, so that the chloride ion concentration in the circulated alkaline solution can be adjusted. NaOH may be reproduced by an ion exchanging method from the leachate (B35) after recovery of zinc carbonate. It is also possible that sodium carbonate is crystallized to be separated and recovered.

Fourth Experimental Example

[Repetitive Zinc Extraction]

As a result of repetitive use of the tailing electrolyte (Q21) generated in the second experimental example as the alkaline solution in the zinc extracting process, 200 ml of a zinc extract (B41) was obtained. The following is a result of an analysis on the concentrations (mg/l) of major components contained in the zinc extract (B41).

Na: 87240, Mg: less than 0.1, Al: 63, K: 725, Ca: 20, Cr: 102, Mn: less than 0.5, Fe: 6, Ni: less than 1, Cu: 17, Cd: less than 1, Sn: less than 15, Pb: 68, Zn: less than 25457, Cl: 1500

[Chlorine Removing Process]

Silver nitrate was added as a chlorine removing agent to the zinc extract (B41) at a chlorine concentration of 1500 mg/l, and deposited AgCl was removed as a chlorine compound (A41) by filtration. Accordingly, the chlorine concentration of a zinc extract (B42) obtained as a filtrate after AgCl was removed was decreased to 240 mg/l.

[Substituting Process]

Metallic zinc particles were brought in contact with the zinc extract (B42) having been subjected to the chlorine removing process, silver salt remaining in the zinc extract (B42) was deposited as metallic silver to be separated by filtration, and a zinc extract (B43) in which silver was substituted by zinc was obtained as a filtrate.

[Electrolyzing Process]

Electrolysis was performed using the zinc extract (B43) having been subjected to the substituting process as an electrolytic bath, and 3.7 g of metallic zinc was won. As the electrolysis conditions, the constant current was 375 mA, the electrodes were SUS304 (flat plates having a thickness of 1 mm and a dimension in a liquid being 20 mm in width and 30 mm in height), the distance between the electrodes was 20 mm, the current density of a geometric area criterion was 62.5 $mA/cm^2$, and the electrolysis time was 10 hours. Obtained metallic Zn was a smooth foil, the Zn deposition current efficiency was 81%, and the average value of the voltages between the electrodes was 2.4 V.

[Supplement]

While silver nitrate was used as a silver ion source, there is a risk that $NO_3^-$ remaining in the electrolytic bath is electrolytically reduced to become $NH_4^-$ and that explosive silver nitride is generated. Accordingly, it is preferable that the silver ion source is a substance other than silver nitrate. The leachate (the tailing electrolyte) after the electrolysis can be cyclically used again as the alkaline solution in the zinc extracting process.

Fifth Experimental Example

[First Zinc Extracting Process]

The same secondary dust (A30) as in the third experimental example was used as the raw material containing Zn. After 100 g of the secondary dust (A30) was added to an NaOH aqueous solution at a concentration of 16.5% and the resultant was agitated, dead-end filtration was performed and solid content (A51) and an alkaline leachate (B51) were obtained. The following is a result of an analysis on the concentrations (mg/l) of major components contained in the alkaline leachate (B51).

Na: 119000, Mg: less than 0.1, Al: 113, K: less than 400, Ca: 20, Cr: 1, Mn: 0, Fe: 2, Ni: less than 2, Cu: 246, Cd: 0, Sn: 12, Pb: 545, Zn: 29518

[Second Zinc Extracting Process]

The solid content (A51) obtained by the first zinc extracting process was added to a new NaOH aqueous solution at 16.5% to further extract Zn, dead-end filtration was performed, and residues (A52) and an alkaline leachate (B52) were obtained. The following is a result of an analysis on the ratios (% by weight) of major components contained in the residues (A52).

Na: 7.2, Mg: 6.0, Al: 0.7, K: less than 0.5, Ca: 1.2, Cr: less than 0.001, Mn: 0.2, Fe: 0.2, Ni: 1.1, Cu: 0.4, Cd: 2.0, Sn: 0.1, Pb: 0.01, Zn: 2.0

[First Substituting Process]

After new metallic zinc particles were added to the alkaline leachate (B51) obtained by the first zinc extracting process and substitution (cementation) was performed, dead-end filtration was performed, and a leachate (B53) after the cementation was obtained. The following is a result of an analysis on the concentrations (mg/l) of major components contained in the leachate (353).

Na: 117612, Mg: less than 1, Al: 13, K: less than 300, Ca: 21, Cr: less than 1, Mn: less than 1, Fe: less than 5, Ni: less than 5, Cu: less than 5, Cd: less than 1, Sn: less than 10, Pb: less than 5, Zn: 29943, Cl: 2000

[First Electrolyzing Process]

By electrolysis using the leachate (B53) obtained by the first substituting process as it was as an electrolytic bath, 2.6 g of metallic zinc powder (P51) (with a purity of 92% and a particle diameter of about 500 μm) was won. As the electrolysis conditions, the constant current was 250 mA, the electrodes were SUS304 (flat plates having a thickness of 1 mm and a dimension in a liquid being 20 mm in width and 20 mm in height), the distance between the electrodes was 20 mm, the current density of a geometric area criterion was 62.5 mA/cm$^2$, and the electrolysis time was eight hours. The leachate (B53) at a $Cl^-$ concentration of 2000 mg/l was electrolyzed as it was without using a chlorine removing agent such as silver salt. The Zn deposition current efficiency was 97.7% and the average value of voltages between the electrodes was 2.35 V.

[Analysis of Metallic Zinc Powder (P51)]

The following is a result of an analysis on the ratios (% by weight) of major components contained in the metallic zinc powder (P51).

Na: less than 5, Mg: less than 0.01, Al: less than 0.1, K: 8. Ca: 0.08, Cr: 0.02, Mn: less than 0.01, Fe: less than 0.1, Ni: less than 0.1, Cu: less than 0.1, Cd: less than 0.01, Sn: less than 1, Pb: less than Zn: 92

[Analysis of Electrolytic Bath after First Electrolyzing Process]

The following is a result of an analysis on the concentrations (mg/l) of major components contained in an electrolytic bath (Q51) remaining after the metallic zinc powder (P51) was won by the first electrolyzing process.

Na: 117750, Mg: less than 1, Al: 13.0, K: less than 300, Ca: 24, Cr: less than 1, Mn: less than 1, Fe: less than 5, Ni: less than 5, Cu: less than 5, Cd: less than 1, Sn: less than 10, Pb: less than 5, Zn: 18402

[Second Substituting Process]

The metallic zinc powder (P51) obtained by the first electrolyzing process was added to the alkaline leachate (B52) obtained by the second zinc extracting process, and substitution (cementation) was performed. A filtrate (B54) after the cementation was obtained by dead-end filtration.

[Second Electrolyzing Process]

By electrolysis using the filtrate (B54) after the cementation as it was as an electrolytic bath (at a chlorine concentration of 250 mg/l), a smooth metallic zinc (foil) was won.

Sixth Experimental Example

[First Alkali Leaching Process]

Electric arc furnace dust of 100 g was brought in contact with 500 ml of an NaOH aqueous solution at a concentration of 45%, leaching was performed for four hours with a maximum temperature at 180° C., and 51.3 g of solid content and 1231 ml of a filtrate containing washing water were obtained.

[Second Alkali Leaching Process]

The solid content obtained by the first alkali leaching process was brought afresh in contact with 500 ml of an NaOH aqueous solution at a concentration of 45%, leaching was performed for four hours with the maximum temperature at 180° C., and 31.6 g of residues and 1337 ml of a filtrate containing washing water were obtained. The following is a result of an analysis on the ratios (% by weight) of major components contained in the residues by an ICP (inductively coupled plasma) analysis method.

Na: 9, Mg: 1.1, Al: 0.3, K: less than 3, Ca: 3.7. Cr: 0.98, Mn: 5.5, Fe: 32, Cu: 0.2, Zn: 8, Cd: 0.12, Sn: less than 0.2, Pb: 0.1

Seventh Experimental Example

Electric arc furnace dust of 4 g, solid NaOH of 6.8 g, and desalinated water of 29 g were mixed and stored in an alumina crucible (100 ml). The mixture (at an NaOH concentration of 17 wt %) in the crucible was heated for 30 minutes to boil the mixture. Desalinated water was added to the heated mixture to dilute the mixture. After the diluted mixture was separated into solid content and a leachate by suction filtration using a glass fiber/C filter paper as a filter medium, desalinated water was added onto the filter medium to wash the solid content. Solid content remaining on the filter medium was handled as residues, and desalinized water having passed through the filter medium was handled as washing water. In this case, the Zn leaching rate was 94.2 wt %.

Eighth Experimental Example

Electric arc furnace dust of 4 g, solid NaOH of 6.8 g, and desalinated water of 29 g were mixed and stored in a glass beaker (100 ml). The mixture (at an NaOH concentration of 17 wt %) in the beaker was heated at 80° C. for about half a day. Desalinated water was added to the heated mixture to dilute the mixture. The diluted mixture was treated in the same manner as in the seventh experimental example, so that a leachate, residues, and washing water were obtained. In this case, the Zn leaching rate was 67.0 wt %.

Ninth Experimental Example

Electric arc furnace dust of 4 g, solid NaOH of 6.8 g, and desalinated water of 29 g were mixed and stored in a polytetrafluoroethylene (PTFE) airtight vessel (100 ml). The mixture (at an NaOH concentration of 17 wt %) in the airtight vessel was heated for 30 minutes to cause the calculation value of the internal pressure of the airtight vessel to have a maximum value of 0.017 MPa. Desalinated water was added to the heated mixture to dilute the mixture. The diluted mixture was treated in the same manner as in the seventh experimental example, and a leachate, residues, and washing water were obtained. In this case, the Zn leaching rate was 82.5 wt %.

Tenth Experimental Example

Electric arc furnace dust of 4 g, solid NaOH of 6.8 g, and desalinated water of 29 g were mixed and stored in a nickel crucible (100 ml). The mixture (at an NaOH concentration of 17 wt %) in the crucible was heated at 100° C. in atmospheric pressure. Desalinated water was added to the heated mixture to dilute the mixture. The diluted mixture was treated in the same manner as in the seventh experimental example, and a leachate, residues, and washing water were obtained. In this case, the Zn leaching rate was 82.0 wt %.

Details of Analysis Results of the Seventh to Tenth Experimental Examples

Table 1 indicates details of analysis results of the leachate, the resides, and the washing water obtained in each of the seventh to tenth experimental examples. The Zn leaching rate (wt %) is the ratio of the amount (g) of Zn leached in the liquid phase (the leachate and the washing water) with respect to the total amount (g) of Zn. Quantitative determination of Zn and Fe in each sample was performed by an ICP analysis of a solution (the leachate, a 35% hydrochloric acid solution of the residues, or the washing water).

TABLE 1

| | Experimental example 7 | Experimental example 8 | Experimental example 9 | Experimental example 10 |
|---|---|---|---|---|
| Amount (ml) of leachate | 47 | 48 | 38 | 38 |
| Amount (ml) of washing water | 88 | 85 | 100 | 100 |
| Amount (g) of residues | 0.9 | 1.9 | 2.3 | 1.8 |
| Zn (g) in leachate | 0.788 | 1.124 | 1.441 | 1.241 |
| Zn (g) in washing water | 0.073 | 0.025 | 0.038 | 0.144 |
| Zn (g) in residues | 0.053 | 0.566 | 0.313 | 0.303 |
| Total amount of (g) of Zn | 0.914 | 1.715 | 1.792 | 1.688 |
| Zn (wt %) in residues | 5.8 | 30 | 14 | 17 |
| Fe (wt %) in residues | 26.3 | 21.6 | 22 | 25 |
| Zn leaching (wt %) | 94.2 | 67.0 | 82.5 | 82.0 |

Eleventh Experimental Example

Electric arc furnace dust of 10 g, solid NaOH of 17 g, and desalinated water of 73 g were mixed and stored in a polytetrafluoroethylene (PTFE) airtight vessel (100 ml). In this case, the NaOH concentration of a solution obtained by mixing the solid NaOH and the desalinated water is 18 wt %. The temperature of the mixture (at an NaOH concentration of 17 wt %) in the airtight vessel was raised to raise the furnace space temperature up to 220° C. in 15 minutes, and was subsequently heated for 5.75 hours while the temperature was kept at 220° C. Desalinated water was added to the heated mixture to dilute the mixture. After the diluted mixture was separated into solid content and a leachate by suction filtration using a glass fiber/C filter paper as a filter medium, an NaOH aqueous solution (at a concentration of 16.25%) was added onto the filter medium to primarily wash the solid content, and desalinated water was further added to secondarily wash the solid content. Solid content remaining on the filter medium was handled as residues, an NaOH aqueous solution having passed through the filter medium was handled as a washing liquid, and desalinated water having passed through the filter medium was handled as washing water. In this case, the Zn leaching rate was 61.2%.

Twelfth Experimental Example

Electric arc furnace dust of 10 g, solid NaOH of 17 g, and desalinated water of 73 g were mixed and stored in an alumina crucible (200 ml), and the mixture was heated on a hot plate. After boiled at about 100° C., the mixture (at an NaOH concentration of 17 wt %) in the crucible was heated for four hours to reach 138° C. Desalinated water was added to the heated mixture to dilute the mixture. The diluted mixture was treated in the same manner as in the eleventh experimental example except that the concentration of an NaOH aqueous solution used in the primary washing was 11.24%, so that a leachate, residues, a washing liquid, and washing water were obtained. In this case, the Zn leaching rate was 84.3%.

Thirteenth Experimental Example

Electric arc furnace dust of 10 g, solid NaOH of 17 g, and desalinated water of 87 g were mixed and stored in a polytetrafluoroethylene (PTFE) airtight vessel (100 ml). In this case, the NaOH concentration of a solution obtained by mixing the solid NaOH and desalinated water is 16 wt %. The temperature of the mixture (at an NaOH concentration of 15 wt %) in the airtight vessel was raised to raise the furnace spatial temperature up to 220° C. in 15 minutes, and the mixture was subsequently heated for 5.25 hours while the temperature was kept at 220° C. Desalinated water was added to the heated mixture to dilute the mixture. The diluted mixture was treated in the same manner as in the eleventh experimental example except that the concentration of an NaOH aqueous solution used in the primary washing was 17.72%, so that a leachate, residues, a washing liquid, and washing water were obtained. In this case, the Zn leaching rate was 69.0%.

Fourteenth Experimental Example

Electric arc furnace dust of 10 g, solid NaOH of 17 g, and desalinated water of 135 g were mixed and stored in an alumina crucible (200 ml). In this case, the NaOH concentration of a solution obtained by mixing the solid NaOH and desalinated water is 11.2 wt %. After the mixture (at an NaOH concentration of 10.5 wt %) in the crucible was heated on a hot plate and was boiled at about 100° C., the mixture was heated for 2.75 hours to reach 180° C. Desalinated water was added to the heated mixture to dilute the mixture. The diluted mixture was treated in the same manner as in the eleventh experimental example except that the concentration of an NaOH aqueous solution used in the primary washing was 17%, so that a leachate, residues, a washing liquid, and washing water were obtained. In this case, the Zn leaching rate was 71.3%.

Fifteenth Experimental Example

Electric arc furnace dust of 10 g, solid NaOH of 67.4 g, and desalinated water of 76 g were mixed and stored in an alumina crucible (200 ml). In this case, the NaOH concentration of a solution obtained by mixing the solid NaOH and desalinated water is 47 wt %. After the mixture (at an NaOH concentration of 44 wt %) in the crucible was heated on a hot plate and was boiled at about 132° C., the mixture was heated for eight hours to reach 180° C. Desalinated water was added to the heated mixture to dilute the mixture. The diluted mixture was treated in the same manner as in the eleventh experimental example except that the concentration of an NaOH aqueous solution used in the primary washing was 46.94%, so that a leachate, residues, a washing liquid, and washing water were obtained. In this case, the Zn leaching rate was 98.6%.

Sixteenth Experimental Example

Electric arc furnace dust of 10 g, solid NaOH of 17 g, and desalinated water of 100 g were mixed and stored in an alumina crucible (200 ml). In this case, the NaOH concentration of a solution obtained by mixing the solid NaOH and desalinated water is 14.5 wt %. After the mixture (at an NaOH concentration of 13.4 wt %) in the crucible was heated on a hot plate and was boiled at about 100° C., the mixture was heated for four hours to reach 210° C. Desalinated water was added to the heated mixture to dilute the mixture. The diluted mixture was treated in the same manner as in the eleventh experimental example except that the concentration of an NaOH aqueous solution used in the primary washing was 17.65%, so that a leachate, residues, a washing liquid, and washing water were obtained. In this case, the Zn leaching rate was 97.0%.

Seventeenth Experimental Example

Residues of 3.3 g sorted from those in the twelfth experimental example, solid NaOH of 17 g, and desalinated water of 100 g were mixed and stored in an alumina crucible (200 ml). In this case, the NaOH concentration of a solution obtained by mixing the solid NaOH and desalinated water is 14.5 wt %. After the mixture (at an NaOH concentration of 14.1 wt %) in the crucible was heated on a hot plate and was boiled at about 100° C., the mixture was heated for 2.26 hours to reach 180° C. Desalinated water was added to the heated mixture to dilute the mixture. The diluted mixture was treated in the same manner as in the eleventh experimental example except that the concentration of an NaOH aqueous solution used in the primary washing was 17.03%, so that a leachate, residues, a washing liquid, and washing water were obtained. In this case, the Zn leaching rate was 98.2%.

Eighteenth Experimental Example

Electric arc furnace dust of 10 g, solid NaOH of 67.4 g, and desalinated water of 76 g were mixed and stored in an alumina crucible (200 ml). In this case, the NaOH concentration of a solution obtained by mixing the solid NaOH and desalinated water is 47 wt %. After the mixture (at an NaOH concentration of 44 wt %) in the crucible was heated on a hot plate and was boiled at about 132° C., the mixture was heated for 2.67 hours to reach 180° C. Desalinated water was added to the heated mixture to dilute the mixture. The diluted mixture was treated in the same manner as in the eleventh experimental example except that the concentration of an NaOH aqueous solution used in the primary washing was 40.12%, so that a leachate, residues, a washing liquid, and washing water were obtained. In this case, the Zn leaching rate was 94.6%.

Details of Analysis Results of the Eleventh to Eighteenth Experimental Examples

Table 2 indicates details of analysis results of the leachate, the resides, the washing liquid, and the washing water obtained in each of the eleventh to eighteenth experimental examples. The Zn leaching rate (wt %) is the ratio of the amount (g) of Zn leached in the liquid phase (the leachate, the washing liquid, and the washing water) with respect to the total amount (g) of Zn. Quantitative determination of Zn and Fe in each sample was performed by the ICP analysis of a solution (the leachate, a 35% hydrochloric acid solution of the residues, the washing liquid, or the washing water).

TABLE 2

| | Experimental example 11 | Experimental example 12 | Experimental example 13 | Experimental example 14 | Experimental example 15 | Experimental example 16 | Experimental example 17 | Experimental example 18 |
|---|---|---|---|---|---|---|---|---|
| Amount (ml) of leachate | 79 | 65 | 90 | 100 | 150 | 80 | 63 | 135 |
| Amount (ml) of washing liquid | 95 | 140 | 82 | 80 | 100 | 79 | 86 | 95 |
| Amount (ml) of washing water | 150 | 240 | 170 | 114 | 345 | 148 | 100 | 227 |
| Amount (g)of residues | 4.5 | 3.6 | 5.9 | 3.8 | 4.1 | 4.2 | 3.5 | 6.6 |
| Zn (g) in leachate | 1.791 | 2.742 | 1.757 | 2.993 | 3.730 | 4.107 | 0.720 | 2.589 |
| Zn (g) in washing liquid | 0.038 | 0.056 | 0.0 | 0.765 | 0.451 | 0.634 | 0.067 | 0.147 |
| Zn (g) in washing water | 0.013 | 0.114 | 0.134 | 0.087 | 0.064 | 0.044 | 0.005 | 0.011 |
| Zn (g) in residues | 1.167 | 0.541 | 0.849 | 1.548 | 0.061 | 0.149 | 0.014 | 0.158 |
| Total amount (g) of Zn | 3.009 | 3.453 | 2.740 | 5.393 | 4.306 | 4.934 | 0.806 | 2.905 |

TABLE 2-continued

| | Experimental example 11 | Experimental example 12 | Experimental example 13 | Experimental example 14 | Experimental example 15 | Experimental example 16 | Experimental example 17 | Experimental example 18 |
|---|---|---|---|---|---|---|---|---|
| Zn (wt %) in residues | 26 | 15 | 14 | 41 | 1 | 4 | 0.41 | 2.4 |
| Fe (wt %) in residues | 26 | 31 | 30 | 18 | 29 | 31 | 25 | 33 |
| Zn leaching rate (wt %) | 61.2 | 84.3 | 69.0 | 71.3 | 98.6 | 97.0 | 98.2 | 94.6 |

Nineteenth Experimental Example

[Electric Arc Furnace Dust]

The ratios (% by weight) of major components contained in electric arc furnace dust used in a nineteenth experimental example were as follows.

Na: 1.49, Mg: 0.55, Al: 0.37, K: 3.13, Ca: 1.38, Cr: 0.56, Mn: 2.15, Fe: 12.3, Ni: 0.03, Cu: 0.16, Cd: 0.06, Sn: 0.02, Pb: 1.78, Zn: 40.59, Si: 1.41, Cl: 4.97

[Alkali Washing and Zinc Extracting Process]

After 100 g of electric arc furnace dust and 730 ml of an NaOH aqueous solution at 0.8% by weight were put into a beaker of 100 ml and were agitated and washed, the resultant was filtered. The obtained washed electric arc furnace dust, 333 g of solid NaOH, and 407 g of desalinated water were mixed and stored in an alumina crucible (2000 ml). After the mixture in the crucible was heated on a hot plate while agitated and was boiled at about 132° C., the mixture was heated for four hours to reach 180° C. Desalinated water was added to the heated mixture to dilute the mixture. The diluted mixture was separated into solid content and a leachate by suction filtration using a glass fiber/C filter paper as a filter medium. In this case, the Zn leaching rate was 94.1%. The resultant unwashed solid content was washed with pure water and was subsequently filtered, so that residues with a dry weight of 33.3 g were obtained.

[Aeration Process]

Air was blown into a sorted leachate to deposit a precipitate containing iron, chromium, and manganese, and the precipitate was separated from a filtrate by suction filtration using a glass fiber/C filter paper as a filter medium.

[Substituting Process]

A leachate having been subjected to the aeration process was brought in contact with metallic zinc particles, and heavy metals such as copper remaining in the leachate were deposited to be separated by filtration, so that a leachate in which the heavy metals such as copper have been substituted by zinc was obtained as a filtrate.

[Electrolyzing Process]

The leachate having been subjected to the substituting process was sorted, and electrolysis was performed using the sorted leachate as an electrolytic bath, so that 3.7 g of metallic zinc was won. As the electrolysis conditions, the constant current was 375 mA, the electrodes were SUS304 (flat plates having a thickness of 1 mm and a dimension in a solution being 20 mm in width and 30 mm in height), the distance between the electrodes was 20 mm, the current density of a geometric area criterion was 62.5 mA/cm$^2$, and the electrolysis time was 10 hours. Obtained metallic Zn was a smooth foil, the Zn deposition current efficiency was 98.4%, and the average value of the voltages between the electrodes was 2.4 V.

INDUSTRIAL APPLICABILITY

The present invention can recover zinc from a raw material containing zinc, such as electric arc furnace dust, and produce a manufactured product such as a zinc metal, zinc oxide, or zinc carbonate.

REFERENCE SIGNS LIST

M motor, S1 dissolving process, S2 solid-liquid separating process, S3 impurity removing process, S4 electrolyzing process, S5 reproducing process, S6 alkali washing process, S7 carbonating process, S8 thermally treating process, S9 alkalinizing process, 1, 1A raw material, 2 alkaline fluid, 3 product, 4 solid phase, 5, 6 liquid phase, 5*a* remover, 5*b* impurity, 7 zinc metals, 8 residual liquid in electrolyzing process, 9 reproduced alkaline fluid, 10, 10A, 20 recovery system, 10*a* alkali aqueous solution, 10*b* alkali washing liquid, 11 pretreatment device, 11*a* pretreated mixture, 12 supply vessel, 12*a* slurry mixture, 13 preheating device, 13*a* heated mixture, 13*b* vapor, 14 reaction vessel, 14*a* reacted mixture, 14*b* mixture being reacting, 15 step-down device, 15*a* water vapor, 16 settling tank, 16*a* supernatant, 16*b* precipitate, 16*c* precipitant, 17 filtering device, 17*a* filtrate, 18 washing tank, 18*a* slurry, 18*b* washing water, 19 dehydrating device, 19*a* residues, 19*b* aqueous phase, 21 carbonation agent, 22 zinc carbonate, 23 zinc oxide, 24 residues in carbonating process, 25 alkalinization agent, 26 carbonate precipitate.

The invention claimed is:

1. A zinc recovery method, comprising:

a dissolving step of treating a raw material containing zinc with an alkaline fluid at a temperature equal or higher than 100° C. to dissolve zinc contained in the raw material; and a recovering step of recovering zinc extracted from the raw material by the dissolving step, wherein the recovering step includes an electrolyzing step of obtaining metallic zinc from a liquid phase containing zinc by electrolysis, an alkali washing step of washing the raw material with an alkali aqueous solution to remove soluble halogen compounds prior to the dissolving step is further included, a concentration of the alkali aqueous solution to be used in the alkali washing step is set to be equal to or lower than 10% by weight so as to be lower than a concentration of the alkaline fluid to be used in the dissolving step, thereby removing the soluble halogen compounds, while the zinc and lead are not to be removed from the raw material, and the alkali aqueous solution having been used for washing in the alkali washing step contains the soluble halogen compounds and is discharged outside a system without being sent to the dissolving step and the electrolyzing step while the raw material from which the soluble halogen compounds have been removed with the alkali aqueous solution by the alkali washing step is sent to the dissolving step, in which in a state where slurry mixture is preheated, with the slurry mixture being obtained by agitating the raw material, from which the soluble halogen compounds have been removed, while supplying the alkaline fluid to the raw material, the slurry mixture is then introduced into a reaction vessel, and in the reaction vessel, the slurry mixture is heated with being agitated at a temperature range of 100° C. to a denaturation temperature of zinc ferrite, thereby obtaining the alkaline fluid in which the zinc contained in the raw material has been dissolved in the dissolving step, and a chlorine concentration in the liquid phase derived from the alkaline fluid to be used as an electrolytic bath is equal to or lower than 1000 ppm in the electrolyzing step.

2. The zinc recovery method according to claim 1, wherein the raw material contains iron.

3. The zinc recovery method according to claim 1, wherein the raw material contains zinc ferrite.

4. The zinc recovery method according to claim 1, wherein the dissolving step is performed in atmospheric pressure and at a temperature between 100° C. and 200° C.

5. The zinc recovery method according to claim 1, wherein the dissolving step is performed under a pressurized condition in pressure higher than atmospheric pressure by 0.017 MPa to 2 MPa and at a temperature between 105° C. and 220° C.

6. The zinc recovery method according to claim 1, wherein the raw material contains an organic halogen compound, the recovering step includes an electrolyzing step of obtaining metallic zinc from a liquid phase containing zinc by electrolysis, and the organic halogen compound is decomposed with the alkaline fluid in the dissolving step to discharge halogen outside a system prior to the electrolyzing step.

7. The zinc recovery method according to claim 1, wherein the recovering step includes a solid-liquid separating step of separating a solid phase containing iron contained in the raw material, and a liquid phase containing zinc from each other.

8. The zinc recovery method according to claim 1, wherein zinc is recovered as a zinc metal in the recovering step.

9. The zinc recovery method according to claim 1, wherein a reproducing step of reproducing an alkaline fluid from alkali metal salt contained in residues having been subjected to the recovering step by electrolysis or concentration is included, and the alkaline fluid obtained in the reproducing step is supplied to the dissolving step.

* * * * *